US011430280B2

(12) United States Patent
Jang

(10) Patent No.: US 11,430,280 B2
(45) Date of Patent: Aug. 30, 2022

(54) SECURITY-REINFORCED DOOR LOCK, AND GATE SECURITY MANAGEMENT SYSTEM USING SAME DOOR LOCK

(71) Applicant: DAMBEE TECHNOLOGY CO., LTD., Hanam-si (KR)

(72) Inventor: Jae Soon Jang, Hanam-si (KR)

(73) Assignee: DAMBEE TECHNOLOGY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/311,399

(22) PCT Filed: Oct. 14, 2020

(86) PCT No.: PCT/KR2020/013966

§ 371 (c)(1),
(2) Date: Jun. 7, 2021

(87) PCT Pub. No.: WO2021/075833

PCT Pub. Date: Apr. 22, 2021

(65) Prior Publication Data

US 2022/0028199 A1 Jan. 27, 2022

(30) Foreign Application Priority Data

Oct. 14, 2019 (KR) ..... 10-2019-0126737
Oct. 14, 2020 (KR) ..... 10-2020-0132409

(51) Int. Cl.

| | |
|---|---|
| ***G07C 9/33*** | (2020.01) |
| ***G07C 9/38*** | (2020.01) |
| ***E05B 49/00*** | (2006.01) |

(52) U.S. Cl.
CPC ..... *G07C 9/33* (2020.01); *E05B 49/00* (2013.01); *G07C 9/38* (2020.01)

(58) Field of Classification Search
CPC ..... G07C 9/33; G07C 9/38; E05B 49/00
See application file for complete search history.

(56) References Cited

U.S. PATENT DOCUMENTS

2021/0026936 A1* 1/2021 Zheng ..... G07C 9/00309

FOREIGN PATENT DOCUMENTS

CN 1674495 A * 9/2005
KR 1020100056688 A 5/2010

(Continued)

*Primary Examiner* — Kam Wan Ma
(74) *Attorney, Agent, or Firm* — You & IP, LLC

(57) ABSTRACT

The present invention relates to a security-reinforced door lock, the security of which is reinforced, and a gate security management system using the same door lock, wherein: a double-unlock function using a security code stored in a user portable terminal, and a password input by a user's key-strokes may be provided so as to enhance user convenience; after a user enters or exits using a security code, the door lock itself may update the security code and the password together, generate multiple different passwords, and restrict the reuse of a single-used password or permit the reuse thereof only within a predetermined time, so as to allow the entry or exit of people who do not own a terminal in which a security code is stored, and prevent the leakage of the password; and multiple-visitor management for a door lock installed at a facility as well as a door lock for a single-woman household can be facilitated, and high security can be provided.

30 Claims, 13 Drawing Sheets

(56) References Cited

FOREIGN PATENT DOCUMENTS

| | | | | |
|---|---|---|---|---|
| KR | 10-1208744 | B1 | | 12/2012 |
| KR | 101259546 | B1 | * | 4/2013 |
| KR | 10-1376279 | B1 | | 3/2014 |
| KR | 10-1726356 | B1 | | 4/2017 |
| KR | 10-2017-0116888 | A | | 10/2017 |
| KR | 102019342 | B1 | | 9/2019 |

* cited by examiner

SECURITY-REINFORCED DOOR LOCK, AND GATE SECURITY MANAGEMENT SYSTEM USING SAME DOOR LOCK

TECHNICAL FIELD

The present disclosure relates to a security-reinforced door lock capable of reinforcing security, while increasing user convenience, by providing a double-unlocking function using a security code stored in a user portable terminal and a password input by a user, and a gate security management system capable of easily managing visitors at a high security level by universally applying the door lock to door locks installed in a plurality of facilities in addition to door locks for female-headed households.

BACKGROUND ART

In general, a door lock is a device installed on a gate to lock/unlock the gate. Commonly, the door lock performs locking and unlocking operations by receiving a password or reading a user's biometric information.

A door lock using a method of receiving a password is relatively cheap and is convenient in that other people (e.g., a friend, a house owner, a delivery person, and a gas-meter reader) are notified of a password, but a password is easily leaked through various paths. A door lock using a method of reading a user's biometric information is expensive, and has a problem in that the access of another person authenticated by family members is fundamentally blocked because the access of an unregistered person is impossible. As another method, there is a method of locking or unlocking a gate by using an electronic key or an electronic tag. This method is easily disabled when an electronic key or an electronic tag is stolen, or is copied without permission.

In 2017, female-headed households exceeded 2.8 million households. It is expected that the female-headed households will exceed 3.80 million households in 2045. Furthermore, according to the survey conducted by the Statistics Korea in 2016, 46% of the female-headed households responded that social safety was unstable. 37% of the female headed households pointed out the occurrence of crimes as an unsafe factor. The Korea Institute of Criminology revealed that the possibility that a female-headed household will be damaged by housebreaking is 11.2 times higher than the possibility that a male-headed household will be damaged by housebreaking. Furthermore, according to the Korea National Police Agency, a total of 71,868 housebreaking-related crimes occurred from 2014 to 2017. A total of 1,310 sexual offences accompanied by housebreaking occurred for the last four years, and the assailants in 99.8% of the 1,310 sexual offences were males. There is a need for a door lock device which is convenient to use while reinforcing security for a family member constituting a female-headed household.

Meanwhile, facilities, such as a relay, a ground electricity facility, a streetlamp distribution box, and a traffic signal controller installed on the ground, are managed by various people, such as a police officer, a manufacturer manager, a maintenance partner manager, a local government manager, and a technical support worker. Door locks which may be locked or unlocked by only authorized users are installed in these facilities. Commonly, a door lock used by multiple people is installed to be unlocked by a password. A fixed password may be easily leaked. An electronic tag, a physical key, etc. is easy to lose, and has a problem in that it is difficult to manage a person who accesses a facility. For this reason, as a high security level is necessary for a door lock installed in a facility used by multiple users, there is a need for a new access management system which can be easily managed.

Korean Patent No. 10-1208744 proposes an intelligent security door lock. In the prior art document, when an electronic key sending an authenticated ID approaches the door lock within a given distance and a confirmation button mounted on the door lock is pressed, the door lock is controlled to be unlocked. However, as described above, an electronic key is easy to lose, and an ID included in the electronic key is highly likely to be copied without permission. Furthermore, there are problems in that since the door lock cannot be unlocked when a user loses the electronic key, the door lock must be forcedly unlocked through a special procedure, and a lot of time is taken to unlock the door lock.

DISCLOSURE

Technical Problem

An object of the present disclosure is to provide a security-reinforced door lock capable of permitting the access of a person who does not own a terminal in which a security code is stored, but preventing the leak of a password by generating a plurality of different passwords when a security code and a password are updated and prohibiting the reuse of a once-used password or permitting the reuse of the once-used password only within a given time, while reinforcing a security level of the door lock, and a gate security management system using the door lock.

Technical Solution

In an embodiment, a security-reinforced door lock, which is installed on a gate and locks and unlocks the gate, the security-reinforced door lock including: a locking and unlocking means configured to lock or unlock the gate; a keypad having numeric keys for the input of a password disposed thereon; a short-distance communication module configured to communicate with a user portable terminal, in which a security code is stored, over a wireless local area network; a security code reader unit configured to read the security code when the user portable terminal becomes close within a communication radius; a password storage unit configured to store the password for locking or unlocking the door lock; a security code storage unit configured to store the security code for locking or unlocking the door lock; a locking and unlocking control unit configured to determine whether the security code read by the security code reader unit is identical with the security code stored in the security code storage unit or whether the password input through the keypad is identical with the password stored in the password storage unit and to change a state of the gate into an unlocking state by operating the locking and unlocking means when the security codes are identical or the passwords are identical; and a security code/password update unit configured to update both the security code and the password after the locking and unlocking control unit unlocks the locking and unlocking means by determining that the security codes are identical, to store the updated security code and the updated password in the security code storage unit and the password storage unit, respectively, and to transmit the updated security code and the updated password to the user portable terminal.

In an embodiment, a gate security management system includes: a security-reinforced door lock installed on a gate and configured to lock or unlock the gate, the security-reinforced door lock including a locking and unlocking control unit configured to determine whether a security code read from a user portable terminal over a wireless local area network or a password input by a user is identical with a prestored security code or a prestored password and to change a state of the gate from a locking state to an unlocking state and a security code/password update unit configured to update both the security code and the password after the locking and unlocking control unit unlocks the locking and unlocking means by determining that the security codes are identical and to transmit the updated security code and the updated password to the user portable terminal; a security management server configured to store and manage the security code and the password for each security-reinforced door lock, to perform a user authentication procedure when a request to issue the security code or a request to issue the password is received from the user portable terminal over a wide band mobile network, and then to remotely issue the security code or the password to the user portable terminal; and the user portable terminal configured to receive the updated security code and the updated password from the security-reinforced door lock and to relay the updated security code and the updated password to the security management server. The security management server updates a security code management database and a password management database with the updated security code and the updated password relayed by the user portable terminal, respectively, and manages the updated security code and the updated password.

Advantageous Effects

According to the security-reinforced door lock of the present disclosure and the gate security management system using the door lock, there are effects in that user convenience can be increased by providing a double-unlocking function using a security code stored in the user portable terminal and a password input by a user's keystrokes, the leak of a password can be prevented by updating both a security code and a password by the door lock itself after access using a security code, but generating a plurality of different passwords and prohibiting the reuse of a once-used password or permitting the reuse of the once-used password only within a given time, and the accesses of multiple visitors to door locks installed in facilities in addition to door locks for female-headed households can be easily managed and high security can also be provided.

MODE FOR INVENTION

Figure 1:
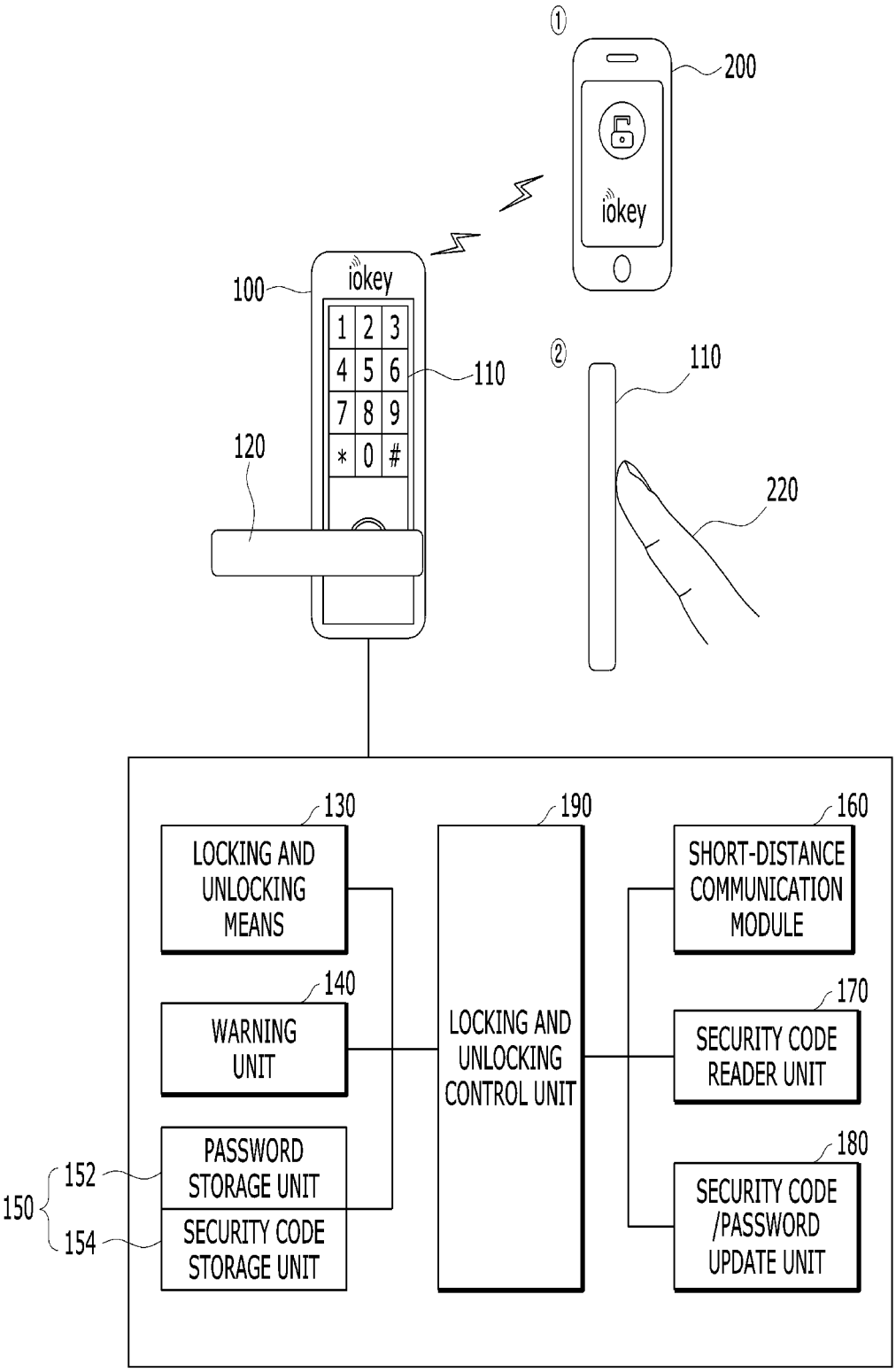
FIG. 1 is a block diagram illustrating a security-reinforced door lock according to the present disclosure.

Hereafter, detailed embodiments according to the present disclosure are described with reference to the accompanying drawings. It is however to be understood that the present disclosure is not intended to be limited to specific embodiments and that the present disclosure includes all changes, equivalents and substitutions which fall within the spirit and technological scope of the present disclosure.

Elements having similar configurations and operations throughout the specification are denoted by the same reference numerals. The accompanying drawings of the present disclosure are for convenience of description and the shapes and relative scales may be exaggerated or omitted.

In describing the embodiments in detail, redundant descriptions or descriptions of technologies that are obvious in the art have been omitted. Furthermore, in the following description, when a part is referred to as "including" another component, it means that the part may further include components in addition to the described component unless otherwise stated.

Furthermore, a term such as " . . . unit", " . . . or (or . . . er)", and " . . . module" described in this specification means a unit for processing at least one function or operation, and this may be implemented with hardware, software, or a combination of the hardware and the software. Furthermore, when a part is referred to as being electrically connected to another part, it may indicate the part is directly connected to the another part or connected to the another part with another configuration interposed therebetween.

Terms including ordinal numbers such as first and second may be used to describe various components, but the components are not limited by the terms. The terms are used only to distinguish one component from another component. For example, a second component may be referred to as a first component and similarly, the first component may also be referred to as the second component without departing from the scope of the present disclosure.

FIG. 1 is a block diagram illustrating a security-reinforced door lock according to the present disclosure.

Referring to FIG. 1, the security-reinforced door lock according to the present disclosure consists of a keypad 110 and a lever 120 exposed to the outside of a door lock device 100, and a locking and unlocking means 130, a warning unit 140, a memory means 150, a short-distance communication module 160, a security code reader unit 170, a security code/password update unit 180, and a locking and unlocking control unit 190, which are installed within the door lock device 100.

The keypad 110 having numeric keys for input of a password disposed thereon and the lever 120 for opening and closing a gate are installed on the front surface of the door lock device 100. The keypad 110 may consist of a physical numeric keypad, a touch key, a touch screen which supports a touch user interface (TUI) and on which numeric key icons, etc. are displayed, etc. As in a common door lock, at the moment when the door lock is unlocked by the locking and unlocking control unit 190, a voice signal that notifies an unlocking state is output. At this time, as the operation locking state of the lever 120 is released, a user may open the gate by manipulating the lever 120.

The locking and unlocking means 130 is a means for locking or unlocking the gate. For example, a solenoid or an electric motor is provided within the door lock device 100. The gate is locked or unlocked in a way that a latch installed in the gate is moved forward or backward to be inserted into or withdrawn from a latch groove formed in a doorframe.

The warning unit 140 may be a buzzer or a speaker that generates a warning sound or may consist of a warning light, an LED, or the like that visually gives a warning. The warning unit 140 outputs a warning sound or turns on a warning light when the locking and unlocking control unit 190 determines that security codes are not identical or passwords are not identical.

The memory means 150 includes a password storage unit 152 for storing a password designated by a user and a security code storage unit 154 for storing a security code updated by the security code/password update unit 180 to be described later. The memory means 150 may consist of a flash memory or the like.

The short-distance communication module 160 is a means for communicating with a user portable terminal 200 over a wireless local area network. The short-distance communication module 160 may consist of a module using radio frequency identification (RFID), Bluetooth, Wi-Fi, Zigbee, or the like, for example.

The security code reader unit 170 is a means for reading a security code when the user portable terminal 200 enters the communication radius of the short-distance communication module 160.

The security code/password update unit 180 updates a security code and a password only after the locking and unlocking control unit 190 determines that security codes are identical and thus changes the state of the gate from a locking state to an unlocking state. If the gate is unlocked because the locking and unlocking control unit 190 determines that passwords are identical, neither of a security code and a password is updated. The security code/password update unit 180 transmits an updated security code and an updated password to the user portable terminal 200. Furthermore, the security code/password update unit 180 stores the updated security code in the security code storage unit 154, and stores the updated password in the password storage unit 152.

The security code is electronically-readable data, and is encrypted key information. The password is a series of numbers or data indicative of a series of numbers. For example, a new password updated by the security code/password update unit 180 is encrypted data indicative of a series of numbers.

In the present disclosure, a security code is updated after being used once and is used only once. Furthermore, the subject that updates the security code is the door lock device not directly accessing to a web. The security code is transmitted to a security management server 500 through the relay of the user portable terminal 200. This provides advantages in that the security code can be managed at a high security level, the leak of the security code through a web can be prevented, and the security code can be easily managed.

In the present disclosure, a password is temporarily used until a security code is updated. The password is used when the user portable terminal 200 is absent or when a user intends to allow another person (hereinafter referred to as a "guest")'s access. A plurality of passwords may be used. A once-used password is discarded, thus preventing unauthorized access even though the password is leaked.

The security code/password update unit 180 encrypts an updated security code and password and transmits the encrypted security code and password to the user portable terminal 200. Furthermore, when relaying the updated security code and the updated password to the security management server 500, the user portable terminal 200 may be programmed not to autonomously store the updated security code and the updated password or to delete the updated security code and the updated password from a temporary repository. Alternatively, the security code/password update unit 180 may transmit, to the user portable terminal 200, command data that instructs the deletion of the updated security code and the updated password after the user portable terminal 200 relays the updated security code and the updated password to the remote security management server 500. Accordingly, a security code or a password can be prevented from being leaked due to hacking into the user portable terminal 200. Furthermore, since a password is updated along with the update of a security code (although the password is not used), unauthorized accesses attributable to the leak of the password can be prevented to the hilt by allowing the password to be temporally used.

The locking and unlocking control unit 190 is a means for controlling an operation of the locking and unlocking means 130. The locking and unlocking control unit 190 controls the change in state of the locking and unlocking means 130 from the locking state to the unlocking state by determining whether a security code read by the security code reader unit 170 is identical with a security code stored in the security code storage unit 154. For example, when a user executes a door lock management app in the user portable terminal 200, the security management server 500 to be described later may issue a new security code, the security code reader unit 170 may read a security code from the user portable terminal 200, and the locking and unlocking control unit 190 determine whether the security codes are identical.

Alternatively, the locking and unlocking control unit 190 controls the change in state of the locking and unlocking means 130 from the locking state to the unlocking state by determining whether a password input by a user is identical with a password stored in the password storage unit 152. For example, in the state in which a user has lost or does not have the user portable terminal 200, the user may access the security management server 500 to be described later by using another communication terminal, such as another portable terminal or a notebook, and may confirm a new password through user authentication. Furthermore, in the state in which the user has activated a touch screen of the keypad 110 of the security-reinforced door lock 100 after having confirmed a password, when the user directly enters the password, the locking and unlocking control unit 190 may determine whether the passwords are identical.

Meanwhile, the locking and unlocking control unit 190 operates the aforementioned warning unit 140 when security codes or passwords are not identical.

In this case, the locking and unlocking control unit 190 unlocks the locking and unlocking means 130 by determining whether the passwords are identical, and then temporarily stops a function of using a password by determining a given condition. That is, after the password is used and the given condition is satisfied, the locking and unlocking control unit 190 operates the locking and unlocking means 130 by determining only whether the security codes are identical.

Furthermore, after the locking and unlocking means 130 is unlocked due to the use of the security code, the locking and unlocking control unit 190 activates the function of using a password again because the security code/password update unit 180 has generated a new security code and a new password. Accordingly, the use of a password may be restricted to a temporary use.

In this case, when updating the password, the security code/password update unit 180 may generate a plurality of different passwords. For example, if a six-digit password is used, the security code/password update unit 180 generates two passwords "123456" and "345678." Furthermore, after the password is updated, the locking and unlocking control unit 190 unlocks the locking and unlocking means 130 when any one password (e.g., "123456") is used, discards the corresponding password, and then controls the door lock to be unlocked only when the remaining password (e.g., "345678") is used. That is, the locking and unlocking control unit 190 may discard the used password, thereby preventing the same password from being leaked and reused.

For example, a family member or a manager may allow a maintenance worker's access by notifying the maintenance worker of the password "123456", and may allow a delivery person's access by notifying the delivery person of the password "345678." However, the family member or manger may discard, thereby preventing a crime attributable to the leak of the password by preventing re-access using the same password.

For another example, the locking and unlocking control unit 190 may set a given use time for any one password (e.g., "123456"). For example, if a use time of the password "123456" issued to the maintenance worker is set to five minutes, the maintenance worker may freely enter and exit from, within the five minutes, a house, a facility, etc. where the door lock of the present disclosure is installed. However, the corresponding password is discarded after the use time elapses, and the issued password cannot be reused after the permitted time, thereby preventing unauthorized access using the same password.

The security-reinforced door lock device of the present disclosure does not directly access a web or a mobile network. The security-reinforced door lock merely accesses the user portable terminal 200 through short-distance wireless communication. Furthermore, the security-reinforced door lock directly updates a security code and a password (one or a plurality of different passwords), and transmits the updated security code and the updated password to the remote security management server 500 through the relay of the user portable terminal 200. Accordingly, the security-reinforced door lock can prevent the security code and the password from being leaked through a web.

The security-reinforced door lock of the present disclosure having the double-unlocking function using a security code and a password has an advantage in that it can reinforce security while providing user convenience. A user can freely enter and exit from a place where the security-reinforced door lock is installed by using a security code stored in his or her portable terminal. Alternatively, a user may permit the restricted access of another person by notifying the person of a temporarily provided password.

Advantages of the security-reinforced door lock of the present disclosure, advantages of the gate management system using the security-reinforced door lock, and detailed embodiments of the security-reinforced door lock and the gate management system are specifically described with reference to FIGS. 2 to 13.

Figure 2:
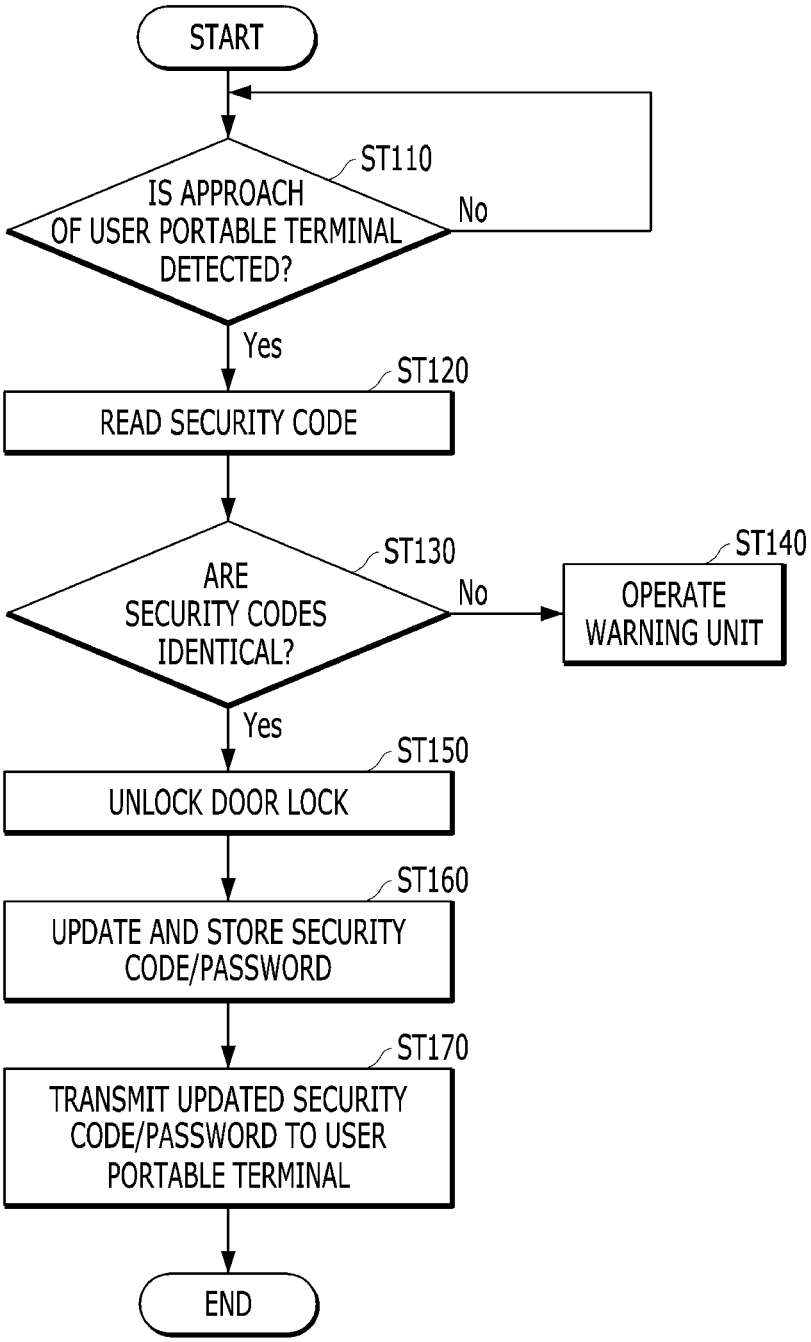
FIG. 2 is a flowchart illustrating an example of operating the door lock using a security code in the present disclosure.
Figure 3:
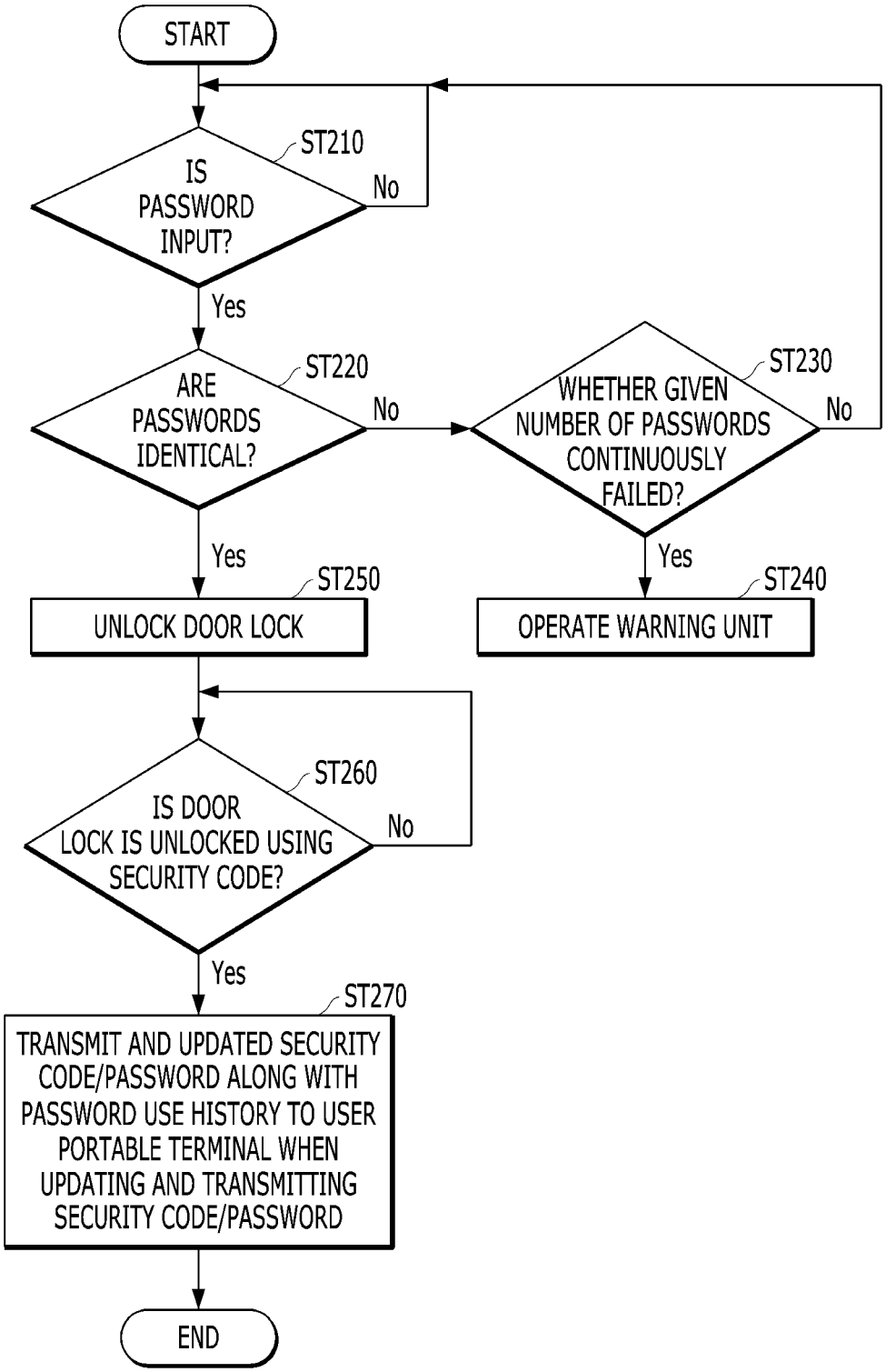
FIG. 3 is a flowchart illustrating an example of operating the door lock using a password in the present disclosure.

FIG. 2 is a flowchart illustrating an example of operating the door lock using a security code in the present disclosure. FIG. 3 is a flowchart illustrating an example of operating the door lock using a password in the present disclosure. A method of operating the security-reinforced door lock according to the present disclosure is described as follows with reference to FIGS. 2 and 3.

Referring to FIG. 2, the locking and unlocking control unit 190 determines whether the user portable terminal 200 has entered a wireless communication radius of the short-distance communication module 160 (ST110). For example, when a user executes a dedicated app by manipulating the user portable terminal 200, the short-distance communication module 160 may be activated. For another example, when the user portable terminal 200 is detected, the short-distance communication module 160 may be activated.

Thereafter, the security code reader unit 170 reads a security code from the user portable terminal 200 (ST120). Furthermore, the locking and unlocking control unit 190 determines whether the read security code is identical with a security code prestored in the security code storage unit 154 (ST130). When the security codes are not identical, the locking and unlocking control unit 190 operates the warning unit 140 as described above (ST140).

When the security codes are determined to be identical in step ST130, the locking and unlocking control unit 190 unlocks the door lock (ST150). At this time, the unlocking state of the door lock may be output in the form of a beep sound or a different voice signal.

Thereafter, as described above, the security code/password update unit 180 updates the security code and the password and stores the updated security code and the update password in the security code storage unit 154 and the password storage unit 152, respectively (ST160).

Furthermore, the locking and unlocking control unit 190 encrypts the updated security code and the updated password and transmits the encrypted security code and password to the user portable terminal 200 (ST170).

In this case, one of important things is that the door lock autonomously updates a security code and a password and transmits the updated security code and the updated password only over a wireless local area network (WLAN) 300. If the door lock directly transmits a security code to the remote security management server through a web, the security code may be leaked over a public network. However, the security-reinforced door lock of the present disclosure autonomously updates a security code and a password whenever the security code is used. Furthermore, as in a gate security management system to be described later, the user portable terminal 200 relays the updated security code and the updated password to the remote security management server 500 and does not leave the updated security code and the updated password therein. Accordingly, the updated security code and the updated password can be prevented from being leaked through a web, and security can also be greatly reinforced because the updated security code and the updated password are not left in the user portable terminal.

Furthermore, another important thing is that even though only a security code is used, a password is also updated when the security code is updated. As described above, when a security code is used, the door lock autonomously updates both the security code and a password, thereby reducing a danger that an unused password is maintained and exposed for a long time without being updated.

Referring to FIG. 3, the locking and unlocking control unit 190 determines whether a password is input through the keypad 110 (ST210). When the password is input, the locking and unlocking control unit 190 determines in a next step whether the input password is identical with a password stored in the password storage unit 152 (ST220).

When the passwords are not identical, the locking and unlocking control unit 190 determines whether the number of continuous times that passwords are not identical reaches a given number (e.g., five times) (ST230). If the determination result in step ST230 indicates "Yes", the locking and unlocking control unit 190 operates the warning unit 140 (ST240).

When the determination result in step ST220 indicates that the passwords are identical, the locking and unlocking control unit 190 unlocks the door lock (ST250). At this time, the unlocking state of the door lock may be output in the form of a beep sound or a different voice signal.

When the door lock is unlocked using the password, the locking and unlocking control unit 190 temporarily stops the function of using a password by determining a given condition. That is, thereafter, the door lock cannot be unlocked by the input of the password. A detailed example in which a used password is discarded and the use of the password is temporarily stopped is described later with reference to FIGS. 4 and 5.

Next, the locking and unlocking control unit 190 determines whether the door lock is unlocked using a security code (ST260). A process of unlocking the door lock by using the security code is the same as that described with reference to FIG. 2.

If the door lock has been unlocked using the security code, the process proceeds to ST160 and ST170 of FIG. 2. When updating the security code and the password and transmitting the updated security code and the updated password to the user portable terminal 200, the security code/password update unit 180 transmits the updated security code and the updated password along with the use history of a previous password (ST270). Accordingly, as will be described later, the remote security management server can store and manage the use history of a password.

Figure 4:
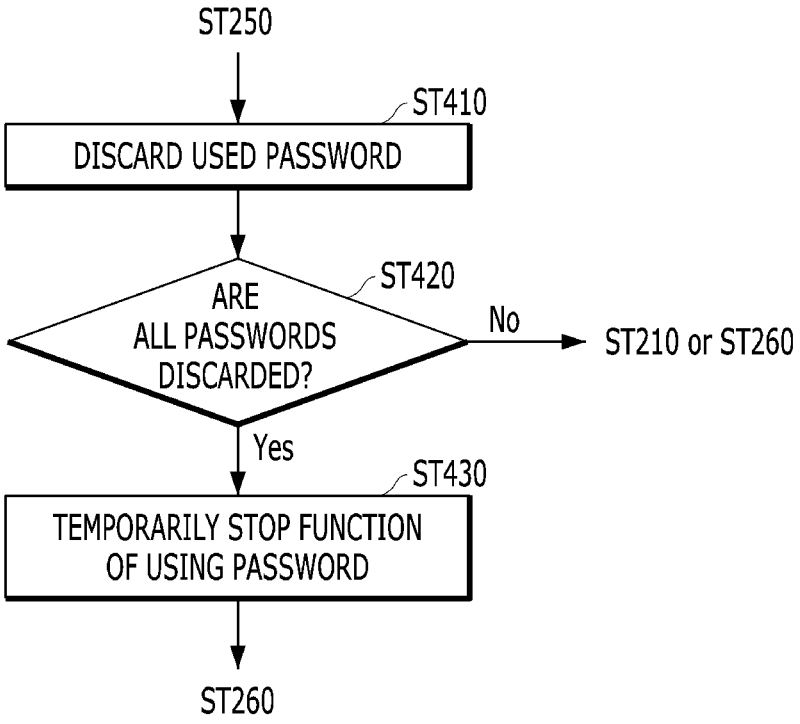
FIG. 4 is a flowchart illustrating an example in which a plurality of passwords is used and discarded in the present disclosure.
Figure 5:
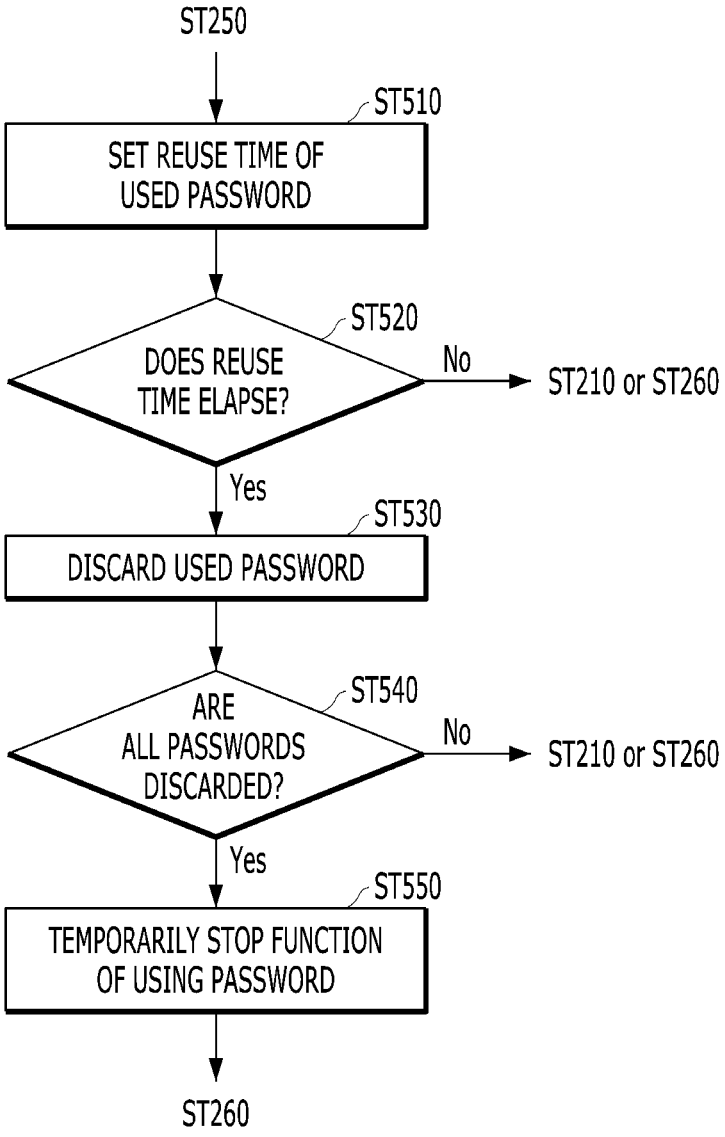
FIG. 5 is a flowchart illustrating an example in which the use time of a password is set and then discarded in the present disclosure.

FIG. 4 is a flowchart illustrating an example in which a plurality of passwords is used and discarded in the present disclosure. FIG. 5 is a flowchart illustrating an example in which the use time of a password is set and then discarded in the present disclosure.

As described above, the security code/password update unit 180 may update a security code and a password and also generate one or more passwords. Furthermore, as illustrated in FIG. 4, the locking and unlocking control unit 190 may allow each of the plurality of passwords to be used only once or may restrict the number of uses of each password. For another example, as illustrated in FIG. 5, the locking and unlocking control unit 190 may restrict the use time of one password.

First, referring to FIG. 4, the locking and unlocking control unit 190 may discard a used password after step ST250 of FIG. 3 is terminated (ST410). Furthermore, the locking and unlocking control unit 190 determines whether all the passwords have been discarded (ST420). If all of the passwords are not discarded, the locking and unlocking control unit 190 proceeds to step ST210. If a security code is used by a user after any one password is used, the locking and unlocking control unit 190 may proceed to step ST260 even after step ST420.

For example, if two passwords "123456" and "345678" have been newly generated and the password "123456" has been input in step ST210 of FIG. 3, the password "123456" will be discarded in step ST410 after the door lock is unlocked in step ST250. Since the other password "345678" is present, the locking and unlocking control unit 190 may proceed to step ST210 and wait until a new password is input. Furthermore, if a security code is used, the security code and the password will be updated through steps ST260 and ST270.

It is assumed that before the security code and the password are updated, both the passwords "123456" and "345678" have been used. The locking and unlocking control unit 190 proceeds to step ST430 and temporarily stops the function of using a password (ST430) because the password "345678" is discarded in step ST410 and the condition of step ST420 is satisfied.

Thereafter, the unlocking of the door lock using the password is impossible until the security code is used in step ST260. After steps ST260 and ST270 are performed, a new password(s) will be issued and a function of unlocking a door lock using a password will be activated again.

Next, referring to FIG. 5, after step ST250 of FIG. 3 is terminated, the locking and unlocking control unit 190 may set the reuse time of a used password (ST510). The reuse time is set by a user. For example, the user may set the reuse time of the password in a way to input a reuse time of about five minutes to ten minutes by pressing a button in the door lock. Alternatively, although not illustrated, the user may set the number of reuses of the password.

In a next step, the locking and unlocking control unit 190 determines whether the reuse time of the corresponding password has elapsed (ST520). This step may be substituted with a step of determining whether the number of reuses of the corresponding password exceeds a set number. The locking and unlocking control unit 190 may return to step ST210 until the reuse time elapses (or until the number of reuses exceeds the set number), and a user may reuse the corresponding password. If a security code is used by a user during the process of determining whether the reuse time elapses, the locking and unlocking control unit 190 may proceed to step ST260.

If the determination result in step ST520 indicates that the reuse time of any password elapses or the number of reuses of the password exceeds the set number, the locking and unlocking control unit 190 discards a corresponding password (ST530). Furthermore, the locking and unlocking control unit 190 proceeds to step ST540 and determines whether all the passwords have been discarded. If all of the passwords are not discarded, the locking and unlocking control unit 190 proceeds to step ST210. If a security code is used by a user in the middle of any step, the locking and unlocking control unit 190 may proceed to step ST260.

If the determination result in step ST540 indicates that all of one or more passwords have been discarded, the locking and unlocking control unit 190 proceeds to step ST550 and temporarily stops the function of using a password (ST550).

Thereafter, the unlocking of the door lock using the passwords are impossible until a security code is used in step ST260. After steps ST260 and ST270 are performed, a new password(s) will be issued, and the function of unlocking a door lock using a password will be activated again.

Figure 6:
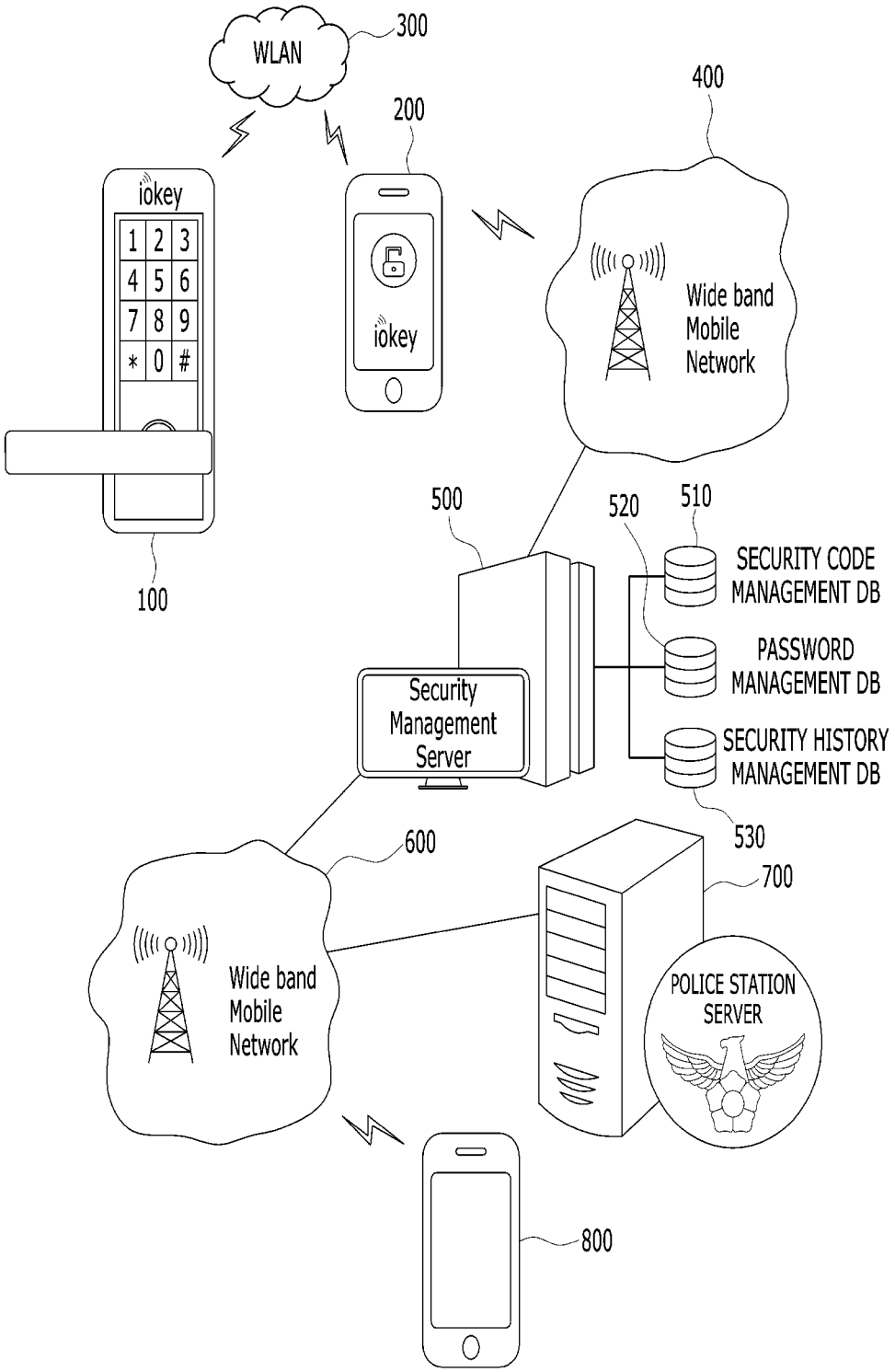
FIG. 6 is a block diagram illustrating a gate security management system according to the present disclosure.

FIG. 6 is a block diagram illustrating the gate security management system according to the present disclosure. The gate security management system according to the present disclosure is described as follows with reference to FIG. 6.

The gate security management system of the present disclosure consists of the security-reinforced door lock 100, the user portable terminal 200, and the security management server 500.

The security-reinforced door lock 100 is the same as that described above with reference to FIGS. 1 to 5.

The user portable terminal 200 is a terminal that communicates with the security-reinforced door lock 100 over the WLAN 300 and communicates with the security management server 500 over a wide band mobile network 400. The user portable terminal 200 may be a dedicated terminal for implementing the gate security management system of the present disclosure, but is preferably a smartphone. A dedicated app for managing a security code may be installed in the user portable terminal 200.

Although not illustrated, the user portable terminal 200 includes a short-distance wireless communication module for communicating with the security-reinforced door lock 100. For example, the short-distance communication module may consist of modules using radio frequency identification (RFID), Bluetooth, Wi-Fi, Zigbee, or the like. Furthermore, the user portable terminal 200 includes a mobile communication module for communicating with the security management server 500. For example, the mobile communication module may be a module for performing mobile communication by using known communication frequency bands, such as 3G, 4G, and 5G, or a module for performing mobile communication by using a next-generation communication frequency band that has not yet been known. For example, the mobile communication module is a module that transmits and receives wireless signals to and from at least one of a base station, an external terminal, and a server over a mobile network constructed using a global system for mobile communication (GSM), code division multi access (CDMA), code division multi access 2000 (CDMA2000), enhanced voice-data optimized or enhanced voice-data only (EVDO), wideband CDMA (WCDMA), high speed downlink packet access (HSDPA), high speed uplink packet access (HSUPA), long term evolution (LTE), long term evolution-advanced (LTE-A), etc.

Furthermore, the user portable terminal 200 includes a memory means for storing a security code and a password issued by the security management server 500. Commonly, a smartphone includes the listed short-distance communication module, mobile communication module, memory, etc.

Furthermore, a user pays a charge for mobile communication and wireless Internet. That is, the smartphone installs therein the door lock management app to be described later with reference to FIGS. 8 to 13, and executes the door lock management app, and is equipped with an optimum environment for implementing the gate security management system according to the present disclosure. Accordingly, by only providing the door lock management app to a portable terminal already used by a user, it is possible to easily realize a request to issue a security code/password, the relay of a security code/password, the unlocking of the door lock, user management, the setting of functions of the door lock, etc., which are described in the present disclosure.

In the present disclosure, the user portable terminal 200 merely relays, to the remote security management server 500, a security code and a password updated by the security-reinforced door lock 100, and does not autonomously store the security code and the password. Furthermore, the door lock management app installed in the user portable terminal 200 may be programmed to autonomously delete an updated security code and password after the security-reinforced door lock 100 transmits information, including the updated security code and password and the use history of each of the security code and the password, to the security management server 500 in step ST170 of FIG. 2.

The security management server 500 communicates with the user portable terminal 200 over the wide band mobile network 400. Referring to FIG. 6, the security management server 500 includes a security code management database (DB) 510 for storing and managing a security code for each security-reinforced door lock 100, a password management DB 520 for storing and managing a password for each security-reinforced door lock 100, and a security history management DB 530 for storing and managing the issue history and use history of each of a security code and a password for each security-reinforced door lock 100. The security code management DB 510, the password management DB 520, and the security history management DB 530 may be storage spaces installed in the security management server 500 or may be implemented as separately managed DB servers.

In the present disclosure, the security management server 500 does not directly generate a security code and a password, and merely stores and manages a security code and a password (autonomously updated by the security-reinforced door lock) relayed through the user portable terminal 200.

When the user portable terminal 200 requests a security code issue, the security management server 500 performs an authentication procedure and then transmits, to the user portable terminal 200, the latest security code stored in the security code management DB 510.

For example, when a user executes the door lock management app in the user portable terminal 200, an authentication request is automatically transmitted to the security management server 500. The security management server 500 may issue a security code by recognizing a telephone number or Mac address of the user portable terminal 200.

Furthermore, when a user accesses a web by using a computer terminal accessible to the Internet, the security management server 500 may show the user the latest password stored in the password management DB 520 by confirming an ID or password of the user or confirming the certificate of the user.

Referring to FIG. 6, the gate security management system of the present disclosure may further include a police station server 700, a guardian portable terminal 800, or other servers or terminals, etc. connected to the security management server 500 or the user portable terminal 200 over a wide band mobile network 600.

When a user manipulates a specific key, a key combination, an emergency situation notification icon disposed on an app execution screen, etc., the door lock management app installed in the user portable terminal 200 may transmit an emergency situation message to the security management server 500, the police station server 700, or the guardian portable terminal 800. For example, if a family member of a female-headed household waits to unlock a gate or a molester approaches the gate, an emergency situation message may be transmitted to the security management server 500 or a pre-designated server or terminal.

Furthermore, the user portable terminal 200 may transmit an emergency situation message to the security-reinforced door lock 100 over the WLAN 300. At this time, the security-reinforced door lock 100 stops a function of unlocking a door lock using a security code, and the function of the security-reinforced door lock 100 may be changed so that the door lock is unlocked by only the input of a password. Accordingly, the door lock can be prevented from being unlocked without permission by a stealer who steals the user portable terminal 200.

Figure 7:
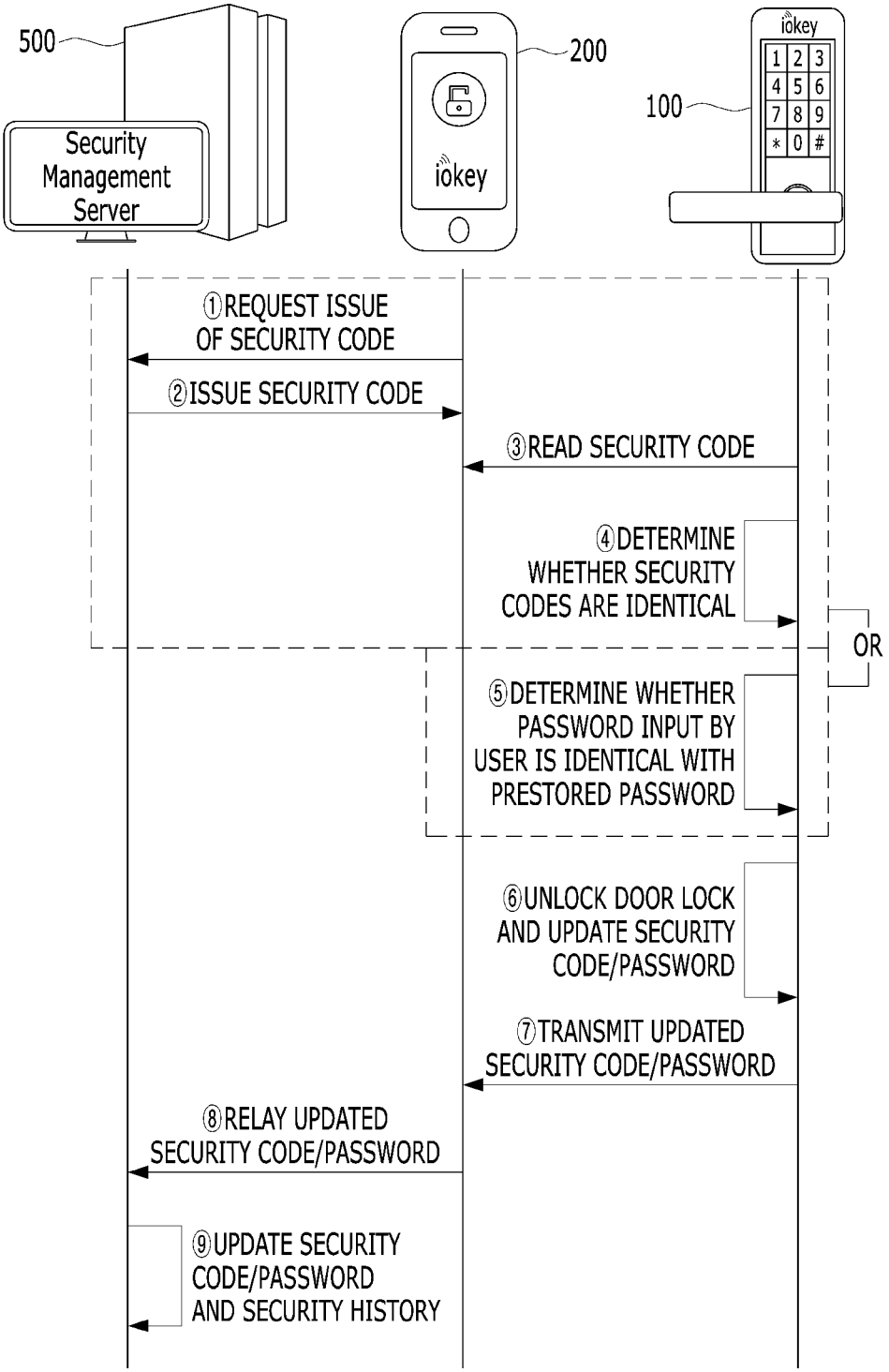
FIG. 7 is a data flowchart illustrating a gate security management method according to the present disclosure.

FIG. 7 is a data flowchart illustrating a gate security management method according to the present disclosure. A data flow between the elements constituting the gate security management system of the present disclosure is described as follows with reference to FIG. 7.

When a user executes the door lock management app in the user portable terminal 200 in order to unlock a gate, a security code issue request signal is transmitted from the user portable terminal 200 to the security management server 500 (step ①). The security management server 500 issues a security code through an authentication procedure for the user portable terminal 200 (step ②).

After the user portable terminal 200 becomes close within a local area wireless radius of the security-reinforced door lock 100, when the user touches a door open icon on an app screen or the locking and unlocking control unit 190 of the security-reinforced door lock 100 is automatically activated, the security-reinforced door lock 100 reads the security code stored in the user portable terminal 200 (step ③). The security-reinforced door lock 100 determines whether the read security code is identical with a prestored security code (step ④).

In substitution for steps ① to ④ when the user directly enters a password through the keypad 110 included in the security-reinforced door lock 100, the security-reinforced door lock 100 may determine whether the password input by the user is identical with a prestored password (step ⑤).

When the security codes are determined to be identical through steps ① to ④, the security-reinforced door lock 100 is unlocked, updates the security code and password, and autonomously stores the updated security code and the updated password in the security code storage unit 154 and the password storage unit 152, respectively (step ⑥).

Furthermore, the security-reinforced door lock 100 transmits the updated security code and the updated password to the user portable terminal 200 (step ⑦). At this time, the updated security code and the updated password are encrypted and the encrypted security code and the encrypted password are transmitted. The security-reinforced door lock 100 may transmit the updated security code and the updated password along with command data that instructs the user portable terminal 200 to delete the updated security code and the updated password after the user portable terminal 200 relays the updated security code and the updated password to the server.

If it is determined that the password input by the user is identical with the prestored password in step ⑤, the security-reinforced door lock 100 is unlocked. Furthermore, when the door lock is unlocked by the input of the password, the security-reinforced door lock 100 temporarily stops the function of using a password immediately or by determining whether the conditions of FIGS. 4 and 5 are satisfied. Thereafter, after determining in step ST260 of FIG. 3 whether the door lock is unlocked using a security code, the security-reinforced door lock 100 transmits, to the user portable terminal 200, the use history of a previous password along with the updated security code and password in step ⑦ according to step ST270.

After step ⑦, the user portable terminal 200 relays the updated security code and the updated password to the security management server 500 (step ⑧). In this case, after relaying the updated security code and the updated password to the security management server 500, the user portable terminal 200 may delete the updated security code and the updated password from an internal temporary storage memory in response to a command from the security-reinforced door lock 100 or according to an autonomous function of the door lock management app.

The security management server 500 updates security histories, such as the use histories of the security code/password, along with the security code and password received from the user portable terminal 200 (step ⑨). When a next security code issue request occurs, the security management server 500 issues the latest security code stored in the security code management DB 510, and shows, to a user, the latest password stored in the password management DB 520 through the authentication of the user who is accessed through a web.

FIGS. 8 to 13 are diagrams illustrating examples in which the door lock management app installed in the user portable terminal is executed in the present disclosure, and illustrate examples in which a user input box, a selection button, etc. are displayed by a touch user interface (TUI). The locking or unlocking of the door lock, the viewing and sharing of a password, the management of a guest, the setting of a door lock function, etc. based on the user portable terminal in the gate security management system according to the present disclosure are described as follows with reference to these drawings.

Figure 8:
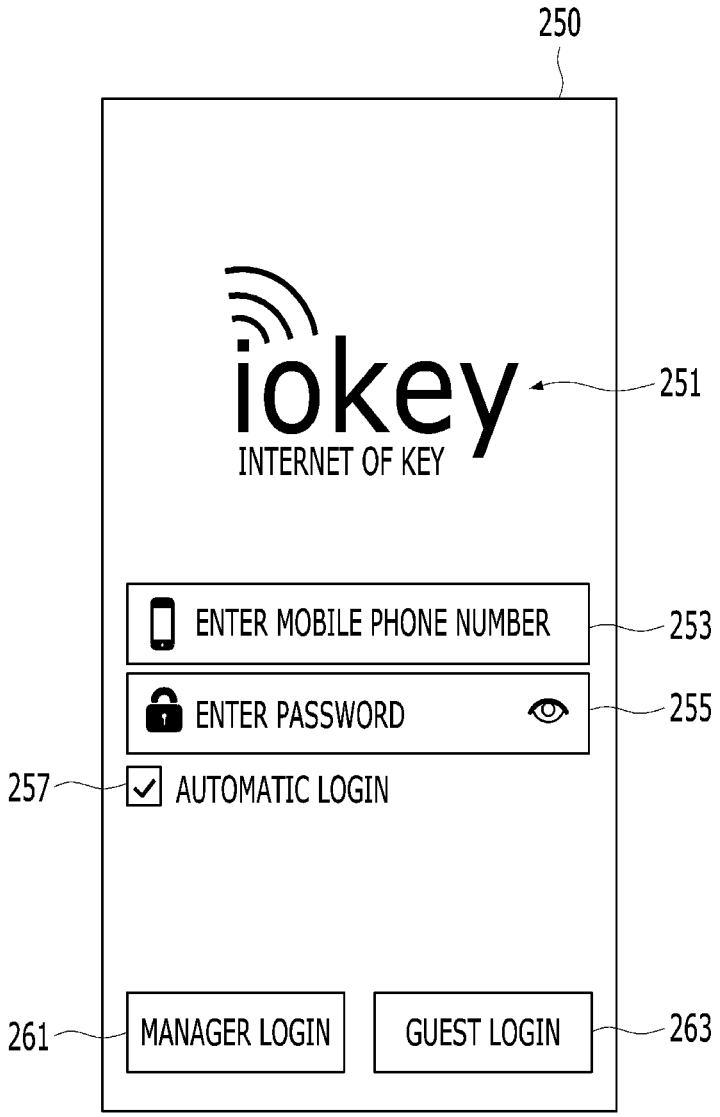
FIG. 8 is a diagram illustrating a user authentication screen of a door lock management app installed in a user portable terminal in the present disclosure.

FIG. 8 is a diagram illustrating a user authentication screen of the door lock management app installed in the user portable terminal in the present disclosure, and illustrates an initial execution screen of the door lock management app. Referring to FIG. 8, a door lock app logo 251 indicating a logo represented so that a user can recognize the execution of the door lock management app is displayed on the upper side in the middle of the user authentication screen. An ID input box 253, a password input box 255, an automatic login check item 257, a manager login input button 261, a guest login input button 263 are displayed below the door lock app logo 251.

The ID input box 253 is a box in which an ID first input by a user or assigned based on user authority is input. For example, a user ID is a mobile phone number of a user registered by the door lock device. The password input box 255 is a box in which a password set by a user or set through the door lock device is input. The automatic login check item 257 is an input item for toggling and setting automatic login and passive login based on a user input.

In the present disclosure, a user is divided into a manager and a guest depending on their authority. The manager has the authority to request the issue of a security code and a password for the security-reinforced door lock 100 and to permit the issue of a security code for a guest, etc. The guest may limitedly use a security code. The authority of the guest to use the security code are adjusted by the manager. The manager and the guest are different in the first registration procedure. It is preferred that the manager is registered by using the security-reinforced door lock 100 and the guest is registered by the permission of the manager.

The manager logs in to the door lock management app through the manager login input button 261, and uses the app through the authentication of the security management server 500. The guest logs in to the door lock management app through the guest login input button 263, and uses the app according to a restricted function set by the manager. In the present disclosure, a "manager portable terminal" means a user portable terminal authenticated through manager login. A "guest portable terminal" means a user portable terminal authenticated through guest login.

Figure 9:
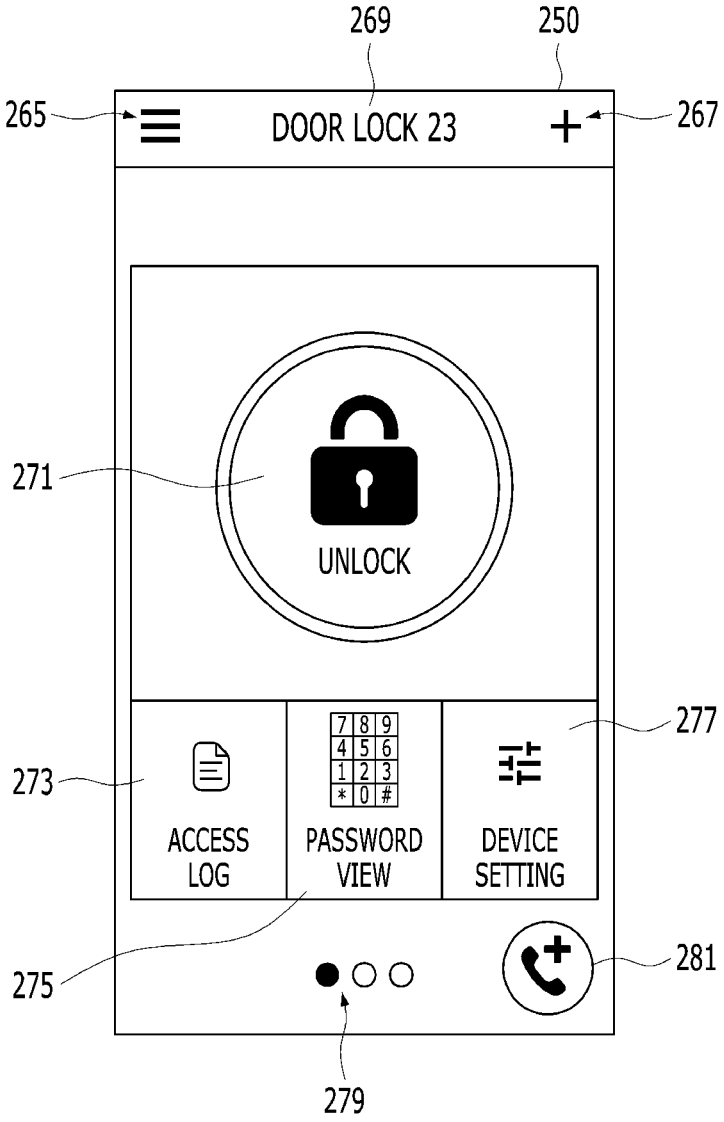
FIG. 9 is a diagram illustrating an example in which the unlocking of the door lock is executed by the door lock management app in the present disclosure.

FIG. 9 is a diagram illustrating an example in which the unlocking of the door lock is executed by the door lock management app in the present disclosure, and is a diagram illustrating an example in which the door lock management app is executed on the manager portable terminal.

After user authentication is performed, a door lock unlocking app page, illustrated in FIG. 9, may be output. A menu button 265 for moving to a menu item or executing a pop-down menu, a door lock name display box 269 for displaying the name of a door lock to be controlled, and a door lock addition button 267 for adding a door lock to be controlled are disposed at the top of the door lock unlocking app page.

A manager may manage an access to a plurality of security-reinforced door locks 200 and a guest. A unique name, such as "door lock 23", is assigned to each of the security-reinforced door locks 200.

Referring to FIG. 9, a door lock unlocking selection button 271 is disposed at the center of the door lock unlocking app page. As illustrated, the door lock unlocking selection button 271 is displayed as an icon intuitively indicating the unlocking of the door lock. When the door lock unlocking selection button 271 is touched by a user, the door lock management app transmits a security code issue request signal to the security management server 500 as in step ① of FIG. 7. Furthermore, as the procedures of steps ② to ④ are performed, the door lock will be unlocked. Thereafter, as the procedures of steps ⑥ to ⑨ are performed, the security management server 500 receives an updated security code through relay, updates the security code management DB 510 with the updated security code, and updates the security history management DB with the use history of a new security code (and the new use history of a password).

Meanwhile, the door lock unlocking selection button 271 is also displayed on the guest portable terminal permitted by a manager. In this case, it is preferred that an access log check button 273, a password view button 275, a device setting button 277, a control target door lock movement slide 279, an emergency call button 281, etc. illustrated in FIG. 9 are displayed only on the manager portable terminal.

Referring to FIG. 9, when the access log check button 273 is touched on the manager portable terminal, the door lock management app accesses the security management server 500 and reads the security history management DB 530. Furthermore, the door lock management app changes the door lock unlocking app page and outputs, on its screen, security code use history information and password use history information for "door lock 23."

Figure 10:
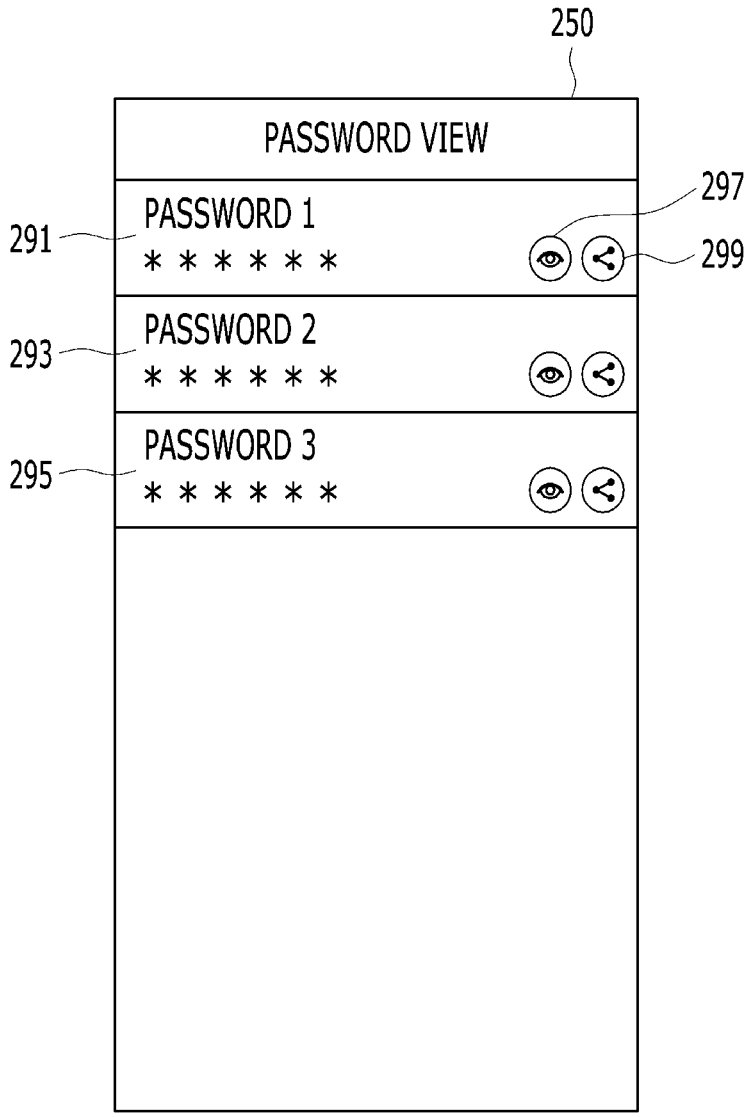
FIG. 10 is a diagram illustrating an example in which the viewing of a password is executed by the door lock management app in the present disclosure.
Figure 11:
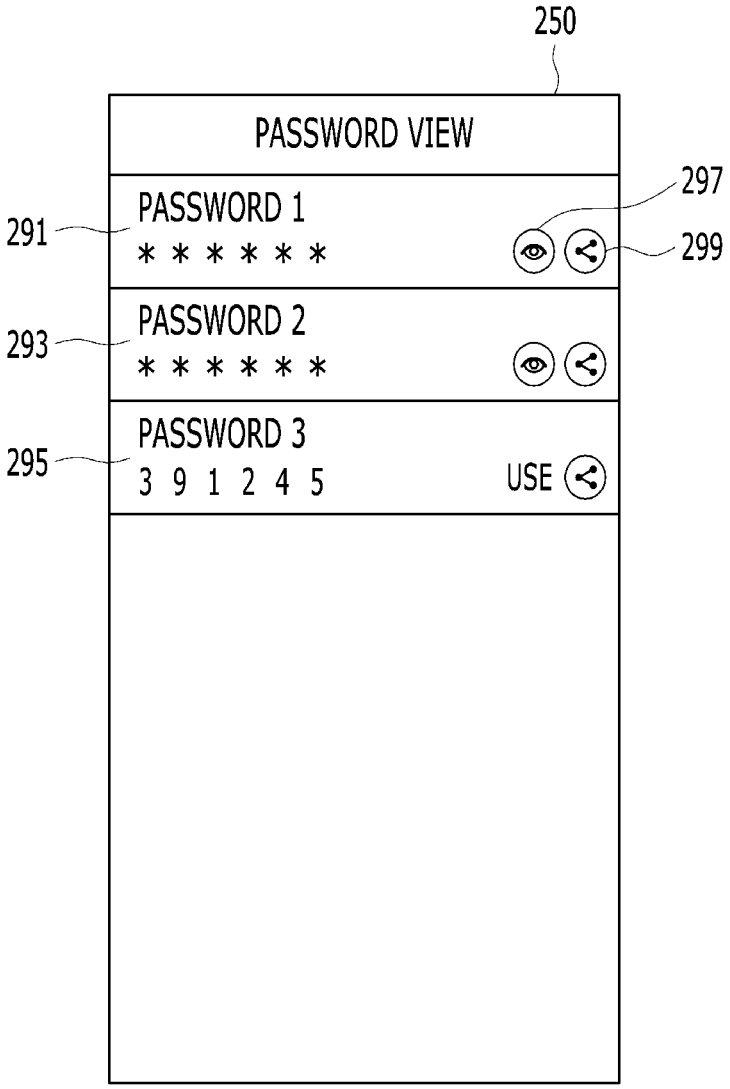
FIG. 11 is a diagram illustrating an example in which the use of a password is executed by the door lock management app in the present disclosure.

When the password view button 275 is touched, the door lock management app changes the door lock unlocking app page into a password view app page illustrated in FIGS. 10 and 11. When the device setting button 277 is touched, the door lock management app changes the door lock unlocking app page into a door lock setting app page illustrated in FIGS. 12 and 13.

The control target door lock movement slide 279 is an input means for a change into a door lock unlocking app page for another security-reinforced door lock 100. For example, when a user slides the control target door lock movement slide 279 to the right on the manager portable terminal, the door lock unlocking app page for "door lock 23" changes into a door lock unlocking app page for "door lock 24." The door lock unlocking app page for "door lock 24" will be disposed to have the same structure as that of FIG. 9.

The emergency call button 281 is a button for a call connection to a pre-defined contact number. For example, when a user touches the emergency call button 281, a call connection to a pre-set telephone number, such as a telephone number of a women security center, 119 or 112, is attempted. Alternatively, as described with reference to FIG. 6, a pre-stored text message that notifies the police station server 700 of an emergency situation may be transmitted.

FIGS. 10 and 11 are diagrams illustrating examples in which the password view app page is displayed on a screen by the door lock management app in the present disclosure. Referring to FIG. 10, the password view app page sequentially displays a plurality of passwords issued by the security management server 500. For example, as described above, when a security code and a password are updated by the security-reinforced door lock 200, if the password is updated into three different passwords, the security management server 500 has updated the three passwords through the relay of the user portable terminal 200. A first password display box 291, a second password display box 293, and a third password display box 295 display different passwords, but the three passwords are displayed by being hidden in masking letters, such as "*." A password view button 297 and a password share button 299 are disposed on the right of each of the password display boxes.

In the example of FIG. 10, when a user touches the password view button 297 for any one password, as in FIG. 11, the masking letters of the corresponding password disappear, and then a password is displayed. The user may unlock the security-reinforced door lock 100 by directly entering the displayed password. Alternatively, the user may notify other people of the displayed password. At this time, the door lock management app may perform short-distance wireless communication with the security-reinforced door lock 100, and may transmit command data to instruct the discarding of a third password "391245" displayed by the user as in FIG. 11 after a given use time (about five minutes to ten minutes) elapses. That is, the security for a once-exposed password can be reinforced by setting a temporary use time for the password.

In the example of FIG. 10, when a user touches the password share button 299 for any one password, the door lock management app may transmit the password to the portable terminal corresponding to a telephone number that is previously designated or input by the user. For example, when the password share button 299 is touched, the app page is changed or a popup window appears so that a telephone number for receiving a password may be input on the changed app page or the popup window. At this time, the corresponding password is displayed to the user by being hidden in masking letters, but the entire password may be displayed to other people who share the password. If the password is shared, the door lock management app may transmit a use time restriction command to the security-reinforced door lock 100.

Figure 12:
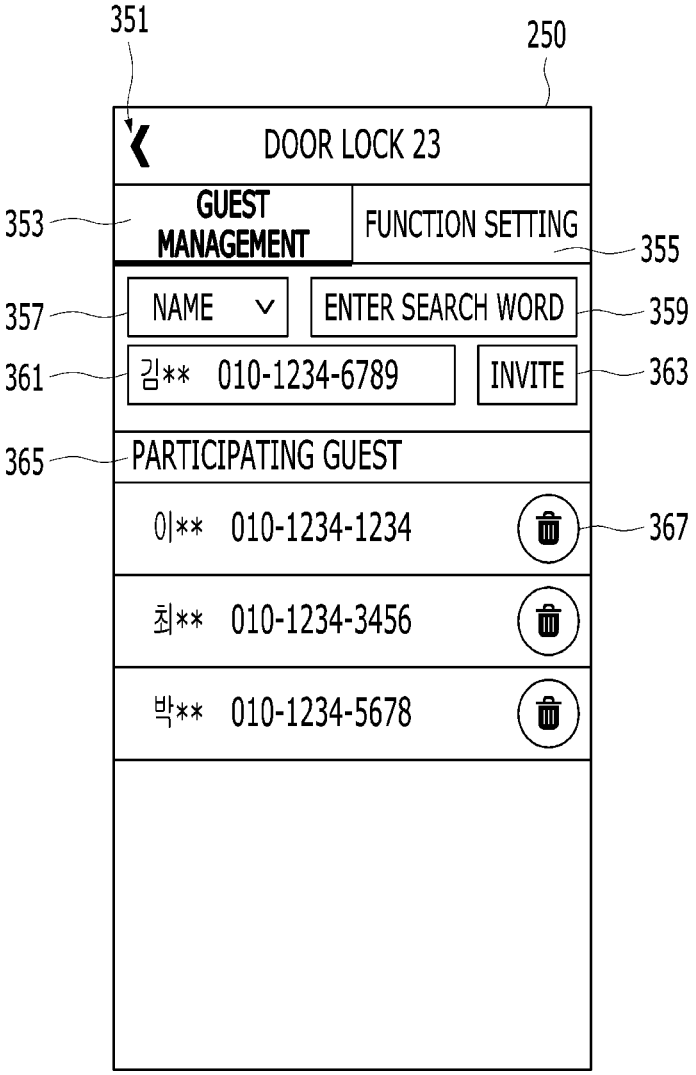
FIG. 12 is a diagram illustrating an example in which the management of a guest is executed by the door lock management app in the present disclosure.
Figure 13:
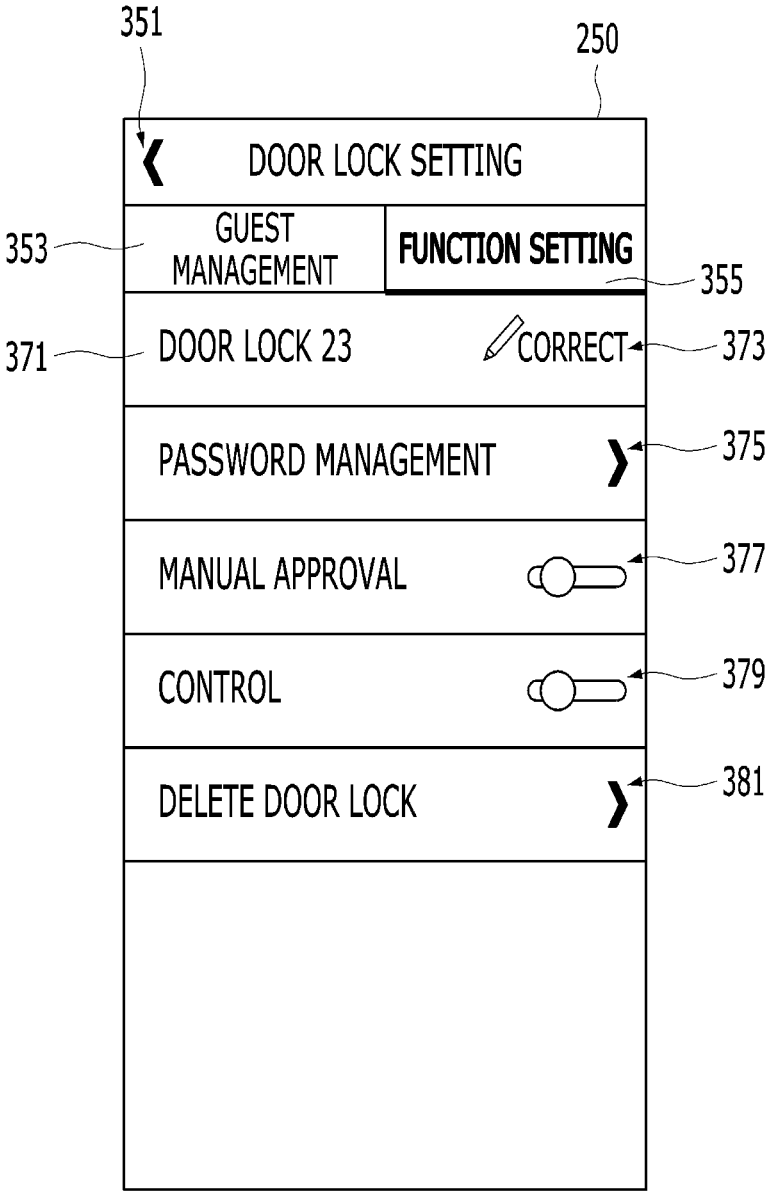
FIG. 13 is a diagram illustrating an example in which the setting of a function is executed by the door lock management app in the present disclosure.

FIGS. 12 and 13 are diagrams illustrating examples in which the door lock setting app page is executed by the door lock management app in the present disclosure. FIG. 12 is a diagram illustrating an example in which the management of a guest is executed. FIG. 13 is a diagram illustrating an example in which the setting of a function is executed.

Referring to FIG. 12, a back button 351 is disposed at an upper left corner of the door lock setting app page. When the back button 351 is touched, the door lock setting app page moves to a previous page (e.g., the door lock unlocking app page of FIG. 9). As in FIG. 12, when a guest management button 353 on the upper side of the screen is touched, the corresponding button is thickly displayed or embossed, and thus a guest management app page is activated.

As illustrated, the guest management app page outputs, on a screen, a search filter selection box 357, a search word input box 359, a guest information display box 361, an invitation button 363, a participating-guest display box 365, and a delete button 367.

The search filter selection box 357 is a box in which a search filter (e.g., a name, a nickname, a telephone number) is selected. The search word input box 359 is a box in which a search word is input. When "name" is selected in the search filter selection box 357 and "김" is input in the search word input box 359, the door lock management app searches, for the corresponding name, a list stored on the manager portable terminal. Furthermore, the door lock management app displays the results of the search in the guest information display box 361. For example, retrieved names and telephone numbers of guests may be displayed in the guest information display box 361. When a user touches the invitation button 363 after checking the guests through the guest information display box 361, the retrieved guests are listed in the participating-guest display box 365 below the guest information display box 361. When the delete button 367 disposed on the right of each guest is touched, the corresponding guest is removed from the participating-guest display box 365**.

The guests listed in the participating-guest display box 365 mean guests who are allowed to use a security code as described above. That is, a manager may allow or block a plurality of guests to use or from using a security code for each security-reinforced door lock 100 as in the example of FIG. 12.

Referring to FIG. 13, when a function setting button 355 on the upper side of a screen is touched, the corresponding button is thickly displayed or embossed, and thus a function setting app page is activated.

The function setting app page displays a door lock name display box 371, a password management screen movement item 375, a manual approval toggle slide bar 377, a control toggle slide bar 379, a door lock delete screen movement item 381 in order from top to bottom.

The name (door lock 23) of the security-reinforced door lock 100 to be controlled is displayed in the door lock name display box 371. A correction button 373 is disposed on the right of the door lock name display box 371. When a user touches the correction button 373, the door lock management app may change the function setting app page into an app page on which the name of a door lock may be corrected or may activate a popup window.

The password management screen movement item 375 is an input means for a change into a screen in which a password is managed. The door lock delete screen movement item 381 is an input means for a change into a screen in which a corresponding security-reinforced door lock is removed from a target to be managed.

The manual approval toggle slide bar 377 is an input item in which whether manual approval is selected in an ON/OFF manner through sliding. When a user moves the manual approval toggle slide bar 377 to the left, a manual approval state becomes OFF, and is set to a state in which a security code may be automatically issued to the participating guests illustrated in FIG. 12. When a user moves the manual approval toggle slide bar 377 to the right, the manual approval state becomes ON, and changes into a state in which a security code may be issued to all the guests through the approval of a manager.

The control toggle slide bar 379 is an input item in which whether to control the security-reinforced door lock is selected in an ON/OFF manner through sliding. When a user moves the control toggle slide bar 379 to the left, a control state becomes OFF, and is set to a state in which a security code may be automatically issued to the participating guests illustrated in FIG. 12. When a user moves the control toggle slide bar 379 to the right, the control state becomes ON and changes into a control state in which the issue of a security code to all the guests is stopped.

The present disclosure can be variously modified without impairing the basic sprit thereof. That is, all the above embodiments should be construed to be illustrative and is not construed to be limitative. Accordingly, the protection scope of the present disclosure should be defined according to the accompanying claims rather than the above embodiments, and when elements defined in the accompanying claims are replaced with equivalents thereof, this should be deemed to fall within the scope of the present disclosure.

The invention claimed is:

1. A security-reinforced door lock, which is installed on a gate and locks and unlocks the gate, the security-reinforced door lock comprising:

a locking and unlocking means configured to lock or unlock the gate;

a keypad having numeric keys for the input of a password disposed thereon;

a short-distance communication module configured to communicate with a user portable terminal, in which a security code is stored, over a wireless local area network;

a security code reader unit configured to read the security code when the user portable terminal becomes close within a communication radius;

a password storage unit configured to store the password for locking or unlocking the door lock;

a security code storage unit configured to store the security code for opening or closing the door lock;

a locking and unlocking control unit configured to determine whether the security code read by the security code reader unit is identical with the security code stored in the security code storage unit or whether the password input through the keypad is identical with the password stored in the password storage unit and to change a state of the gate into an unlocking state by operating the locking and unlocking means when the security codes are identical or the passwords are identical; and a security code/password update unit configured to update both the security code and the password after the locking and unlocking control unit unlocks the locking and unlocking means by determining that the security codes are identical, to store the updated security code and the updated password in the security code storage unit and the password storage unit, respectively, and to transmit the updated security code and the updated password to the user portable terminal.

2. The security-reinforced door lock of claim 1, wherein when updating the password, the security code/password update unit updates the password into a plurality of different passwords.

3. The security-reinforced door lock of claim 2, wherein after any one of the passwords is used so that the locking and unlocking means is unlocked, the locking and unlocking control unit discards the used password and performs an unlocking operation for only another password.

4. The security-reinforced door lock of claim 3, wherein after all the passwords are used so that the locking and unlocking means is unlocked, the locking and unlocking control unit temporarily stops a function of using the password until the password is next updated.

5. The security-reinforced door lock of claim 2, wherein after any one of the passwords is used so that the locking and unlocking means is unlocked, the locking and unlocking control unit sets a reuse time of the used password within a given time or sets the number of reuses of the used password within a given number, and when the reuse time elapses or the number of reuses reaches the given number, the locking and unlocking control unit discards the used password and performs an unlocking operation for only another password.

6. The security-reinforced door lock of claim 5, wherein when the reuse times of all the passwords elapse or the numbers of reuses of all the passwords reach the given number, the locking and unlocking control unit temporarily stops a function of using the password until the password is next updated.

7. The security-reinforced door lock of claim 1, wherein when updating the security code and the password and transmitting the updated security code and the updated password to the user portable terminal, the security code/password update unit transmits the updated security code and the updated password, along with security code use history information indicative of a use history of the security code.

8. The security-reinforced door lock of claim 7, wherein when updating the security code and the password and transmitting the updated security code and the updated password to the user portable terminal, the security code/password update unit transmits the updated security code and the updated password, along with password use history information indicative of a use history of the password, if the use history of the password is present.

9. The security-reinforced door lock of claim 1, wherein:

the security code is electronically-readable data, the password is data indicative of a series of numbers, and the security code/password update unit encrypts the updated security code and the updated password and transmits the encrypted security code and the encrypted password to the user portable terminal.

10. The security-reinforced door lock of claim 9, wherein when transmitting the updated security code and the updated password to the user portable terminal, the security code/password update unit transmits the updated security code and the updated password, along with command data that instructs the user portable terminal to delete the updated security code and the updated password after relaying the updated security code and the updated password to a remote security management server.

11. A gate security management system comprising:

a security-reinforced door lock installed on a gate and configured to lock and unlock the gate, the security-reinforced door lock comprising: a locking and unlocking control unit configured to determine whether a security code read from a user portable terminal over a wireless local area network or a password input by a user is identical with a prestored security code or a prestored password and to change a state of the gate from a locking state to an unlocking state; and a security code/password update unit configured to update both the security code and the password after the locking and unlocking control unit unlocks the locking and unlocking means by determining that the security codes are identical and to transmit the updated security code and the updated password to the user portable terminal;

a security management server configured to store and manage the security code and the password for each security-reinforced door lock, to perform a user authentication procedure when a request to issue the security code or a request to issue the password is received from the user portable terminal over a wide band mobile network, and then to remotely issue the security code or the password to the user portable terminal; and the user portable terminal configured to receive the updated security code and the updated password from the security-reinforced door lock and relay the updated security code and the updated password to the security management server, wherein the security management server updates a security code management database and a password management database with the updated security code and the updated password relayed by the user portable terminal, respectively, and manages the updated security code and the updated password.

12. The gate security management system of claim 11, wherein when updating the password, the security code/password update unit updates the password into a plurality of different passwords.

13. The gate security management system of claim 12, wherein after any one of the passwords is used so that the state of the gate is changed from the locking state to the unlocking state, the locking and unlocking control unit discards the used password and performs an unlocking operation for only another password.

14. The gate security management system of claim 13, wherein after all the passwords are used so that the state of the gate is changed from the locking state to the unlocking state, the locking and unlocking control unit temporarily stops a function of using the password until the password is next updated.

15. The gate security management system of claim 12, wherein after any one of the passwords is used so that the state of the gate is changed from the locking state to the unlocking state, the locking and unlocking control unit sets a reuse time of the used password within a given time or sets the number of reuses of the used password within a given number, and when the reuse time elapses or the number of reuses reaches the given number, the locking and unlocking control unit discards the used password and performs an unlocking operation for only another password.

16. The gate security management system of claim 15, wherein when the reuse times of all the passwords elapse or the numbers of reuses of all the passwords reach the given number, the locking and unlocking control unit temporarily stops a function of using the password until the password is next updated.

17. The gate security management system of claim 11, wherein:

when updating the security code and the password and transmitting the updated security code and the updated password to the user portable terminal, the security code/password update unit transmits the updated security code and the updated password, along with security code use history information indicative of a use history of the security code, and the security management server receives the security code use history information relayed through the user portable terminal and stores and manages the received security code use history information in a security history management database.

18. The gate security management system of claim 17, wherein:

when updating the security code and the password and transmitting the updated security code and the updated password to the user portable terminal, the security code/password update unit transmits the updated security code and the updated password, along with password use history information indicative of a use history of the password, if the use history of the password is present, and the security management server receives the password use history information relayed through the user portable terminal and stores and manages the received password use history information in the security history management database.

19. The gate security management system of claim 11, wherein:

the security code is electronically-readable data, the password is data indicative of a series of numbers, and the security code/password update unit encrypts the updated security code and the updated password and transmits the encrypted security code and the encrypted password to the user portable terminal.

20. The gate security management system of claim 19, wherein the user portable terminal deletes the updated security code and the updated password from its own temporary repository, after relaying the updated security code and the updated password to the security management server.

21. The gate security management system of claim 19, wherein when transmitting the updated security code and the updated password to the user portable terminal, the security code/password update unit transmits the updated security code and the updated password, along with command data that instructs the user portable terminal to delete the updated security code and the updated password after relaying the updated security code and the updated password to the security management server.

22. The gate security management system of claim 11, wherein:

the user portable terminal is a terminal in which a door lock management app for managing a use of the security code or the password for each security-reinforced door lock is installed, and the door lock management app provides a door lock unlocking selection button through a touch user interface in the user portable terminal and receives the updated security code issued by the security management server when a user touches the door lock unlocking selection button.

23. The gate security management system of claim 18, wherein:

the user portable terminal comprises a manager portable terminal and a guest portable terminal, and the manager portable terminal accesses the security management server and allows the guest portable terminal to use the security code for each security-reinforced door lock.

24. The gate security management system of claim 23, wherein when an access log check button for the security-reinforced door lock is touched on the touch user interface, the manager portable terminal accesses the security management server, reads the security history management database, and outputs the security code use history information and the password use history information for each security-reinforced door lock on a screen of the manager portable terminal.

25. The gate security management system of claim 13, wherein when a password view button for the security-reinforced door lock is touched on the touch user interface, the user portable terminal outputs, on a screen of the user portable terminal, a password view app page on which a plurality of passwords issued by the security management server is sequentially displayed.

26. The gate security management system of claim 25, wherein the password view app page hides the passwords by masking the passwords, removes the masking when a password view button disposed adjacent to each of the passwords is touched by a user, and displays the passwords.

27. The gate security management system of claim 26, wherein the password view app page further comprises a password share button disposed adjacent to each of the passwords, and transmits the password to a portable terminal corresponding to a telephone number previously designated or input by the user when the user touches the password share button.

28. The gate security management system of claim 15, wherein when a password view button for the security-reinforced door lock is touched on a touch user interface, the user portable terminal displays, on a screen of the user portable terminal, a password view app page on which a plurality of passwords issued by the security management server is sequentially displayed.

29. The gate security management system of claim 28, wherein the password view app page hides the passwords by masking the passwords, removes the masking when a password view button disposed adjacent to each of the passwords is touched by a user, and displays the passwords.

30. The gate security management system of claim 29, wherein the password view app page further comprises a password share button disposed adjacent to each of the passwords, and transmits the password to a portable terminal corresponding to a telephone number previously designated or input by the user when the user touches the password share button.

* * * * *